United States Patent [19]

Sergev et al.

[11] 4,367,845

[45] Jan. 11, 1983

[54] AUTOMATIC TEMPERATURE CONTROL SYSTEM FOR DIVER HEATING SYSTEM

[75] Inventors: Sergius S. Sergev, Ventura; Theodore J. Roster, Oxnard, both of Calif.

[73] Assignee: The United States of America as represented by the Secretary of the Navy, Washington, D.C.

[21] Appl. No.: 288,247

[22] Filed: Jul. 29, 1981

Related U.S. Application Data

[62] Division of Ser. No. 143,079, Apr. 24, 1980, Pat. No. 4,295,604.

[51] Int. Cl.[3] ..... F23N 5/06

[52] U.S. Cl. ..... 236/21 R; 236/86

[58] Field of Search ..... 236/21 R, 21 B, 86, 236/99 R; 73/368, 368.7; 251/61.2, 122, DIG. 4, 359

[56] References Cited

U.S. PATENT DOCUMENTS

| | | | |
|---|---|---|---|
| 1,860,189 | 5/1932 | Lawler | 73/368 X |
| 1,999,697 | 4/1935 | Kleckner et al. | 137/116 |
| 2,283,311 | 5/1942 | Bevins | 251/359 X |
| 2,836,365 | 5/1958 | Swenson et al. | 236/21 |
| 3,428,291 | 2/1969 | Callahan, Jr. et al. | 251/122 |
| 4,094,314 | 6/1978 | Le Corner | 251/359 X |

*Primary Examiner*—William E. Tapolcai

*Attorney, Agent, or Firm*—Robert F. Beers; Joseph M. St.Amand

[57] ABSTRACT

In a diver heating system of the type in which a fluid being circulated in the circulation passage of the diver's clothing is heated by the controlled combustion of a reducing metal in an oxygen atmosphere, a temperature control system in which a gas flow control valve controls the oxygen flow to the reaction to automatically maintain a preset temperature of the circulating fluid and a gas shut-off valve serves as a backup to quickly shut-off the oxygen flow if the temperature of the circulating fluid exceeds a preset value. In both the gas flow control valve and the gas shut-off valve, the heated water is fed through a heat exchanger where it is in thermal contact with a thermofluid so that heat is transferred between the two fluids. The change in volume of the thermofluid with temperature is coupled to a motion bellows which operates to control the flow of oxygen through an orifice.

3 Claims, 6 Drawing Figures

AUTOMATIC TEMPERATURE CONTROL SYSTEM FOR DIVER HEATING SYSTEM

This is a division of application Ser. No. 143,079 filed Apr. 24, 1980, now U.S. Pat. No. 4,295,604.

BACKGROUND OF THE INVENTION

This invention relates in general to automatic temperature control systems for diver heating systems and, in particular to a diver heating system incorporating thermally controlled gas flow valves for controlling the flow of oxygen to a combustion process that heats water being circulated through the diver's clothing. More particularly, this invention relates to a gas flow valve and a gas shut-off valve in which the operating state of the valves is controlled by the temperature of a fluid.

In order to permit a diver to work for prolonged periods immersed in cold water, diving suits have internal circulation passages through which a heated fluid is circulated. One method of heating this circulating fluid involves the controlled combustion of a metal such as magnesium in an oxygen atmosphere with the combustion rate determined by the rate of oxygen flow to the process. A previous method of controlling the gas flow to the reaction process used a rubber sleeve over a closed-ended tube having radial holes. Pressurized oxygen flowed into the tube, through the holes, along the sleeve and out another tube. A thermo wax was disposed surrounding the inner tube within a larger outer tube. The thermo wax was in thermal contact with the heated fluid through the outer tube. As the temperature of the circulating fluid increased, the thermo wax would expand and compress the sleeve against the radial holes in the inner tube. This restricted gas flow through the device. The restricted gas flow slowed the reaction and gradually reduced the heated fluid temperature. As the fluid temperature dropped, the wax would contract and allow gas to flow with less restriction through the radial holes. This method for controlling gas flow to the reaction process, although automatic, did not permit adjustment of the control temperature nor provide precise temperature regulation.

SUMMARY OF THE INVENTION

It is therefore an object of the present invention to provide automatic temperature control of the circulatfluid in a diver heating system.

Another object of the present invention is to provide temperature control in which the temperature of the circulating fluid is adjustable by the diver.

A further object of the present invention is to provide temperature control in which the temperature of the circulating fluid is precisely regulated.

Another object of the present invention is to provide a gas flow control valve in which the gas flow is automatically controlled by the temperature of a circulating fluid.

Yet another object is to provide a thermally controlled gas flow valve in which the control temperature is adjustable manually.

A further object is to provide a gas flow shut-off valve in which the gas shut-off is automatically controlled by the temperature of the circulating fluid.

Still another object is to provide an automatic gas flow shut-off valve in which the shut-off temperature is adjustable.

These and other objects are provided in a diver heating system in which water being circulated in the circulation passages of the diver's clothing is heated by a controlled magnesium-oxygen reaction. Oxygen is fed to the combustion process via a novel gas flow valve and a novel gas shut-off valve, both of which operate by sensing the temperature of the water being circulated in the diver's clothing.

The gas flow control valve controls the oxygen flow to the reaction to automatically maintain a preset temperature of the circulating heated water. The heated water is fed through a heat exchanger where it is in thermal contact with a thermofluid (such as cyclohexane) so that heat is transferred between the heated water and the thermofluid. The heat transfer changes the temperature of the thermofluid which causes a change in the volume. This change in volume of the thermofluid is transmitted to a motion bellows which operates to move a tapered needle in and out of a tapered gas orifice to vary the effective size of the orifice and thus the oxygen flow. The position of the needle relative to the orifice is manually adjustable during operation by the diver to change the control temperature.

The shut-off valve serves as a back-up to the gas flow control valve to quickly shut-off the oxygen flow if the temperature of the circulating fluid exceeds a preset value. As is the case with the gas flow control valve, the heated water is fed through a heat exchanger where it is in thermal contact with a thermofluid. The heat transfer between the heated water and the thermofluid changes the temperature of the thermofluid which causes a change in volume. This change in volume of the thermofluid is transmitted to a motion bellows which operates to move a valve plug to seal or unseal a gas orifice.

One feature the flow control valve is that the motion bellows is maintained near the hot water temperature to effectively isolate the bellows from the influence of the non-predictable environmental temperature (i.e., the ocean temperature).

Another feature is that both valves are provided with a second bellows which serves to relieve over pressure in the thermofluid system to protect the motion bellows.

Another feature of both valves is that the thermofluid is automatically pressure compensated for the effects of environmental pressure.

Another feature of the flow valve is that it inherently compensates for changes in the gas density which would affect the combustion process.

Other objects and many attendant advantages and features will be readily appreciated as the subject invention becomes better understood by the reference to the following detailed description, when considered in conjunction with the accompanying drawings wherein:

DESCRIPTION OF THE PREFERRED EMBODIMENT

Figure 1:
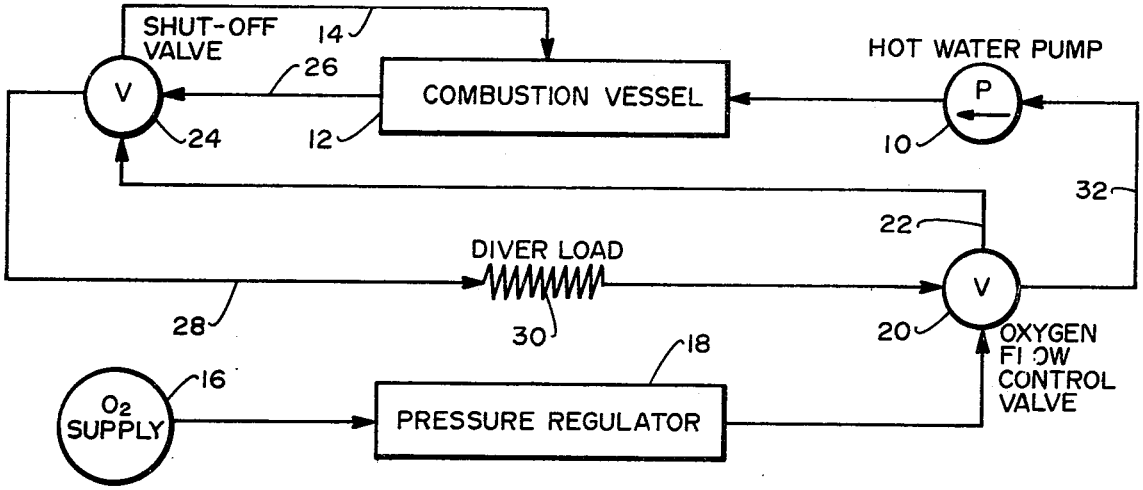
FIG. 1 is a block diagram illustrating a diver heating system using a thermally controlled gas flow valve and a thermally controlled gas shut-off valve to control the flow of oxygen to a combustion vessel.

Referring now to the drawing wherein like reference characters refer to like parts in the several views and, in particular to FIG. 1, the present invention may be used with a diver heater unit that employs the controlled combustion of a reducing metal such as magnesium metal in an oxygen atmosphere as a heat source. The warm liquid (typically water) being circulated in a diver's clothing is fed through a water pump 10 into a combustion vessel 12 where the oxygen reacts with the magnesium and the heat from this reaction is injected into the moving liquid. The combustion rate and thus the heat input to the circulating liquid is controlled by controlling the gas flow over line 14 to the combustion vessel 12. The oxygen is fed from an oxygen supply 16 through a pressure regulator 18 to a thermally controlled gas flow valve 20, which based on the temperature of the circulating liquid, controls the flow of oxygen over line 22. The oxygen flowing in line 22 is fed to a thermally controlled gas shut-off valve 24 which acts as a back-up to the flow control valve 20 to quickly terminate the oxygen supply to the combustion vessel 12 is the temperature of the liquid exceeds a preset value.

The heated circulating liquid is fed from the combustion vessel 12 to the gas shut-off valve 24 over line 26. After passing through the gas shut-off valve 24, the heated liquid is circulated through circulation passages in the diver's clothing, represented by line 28, providing a thermal load 30 to the liquid. The heated liquid is then fed through the gas flow control valve 20 which controls the gas flow in response to the temperature thereof, and then into the water pump 10 over line 32.

Figure 2:
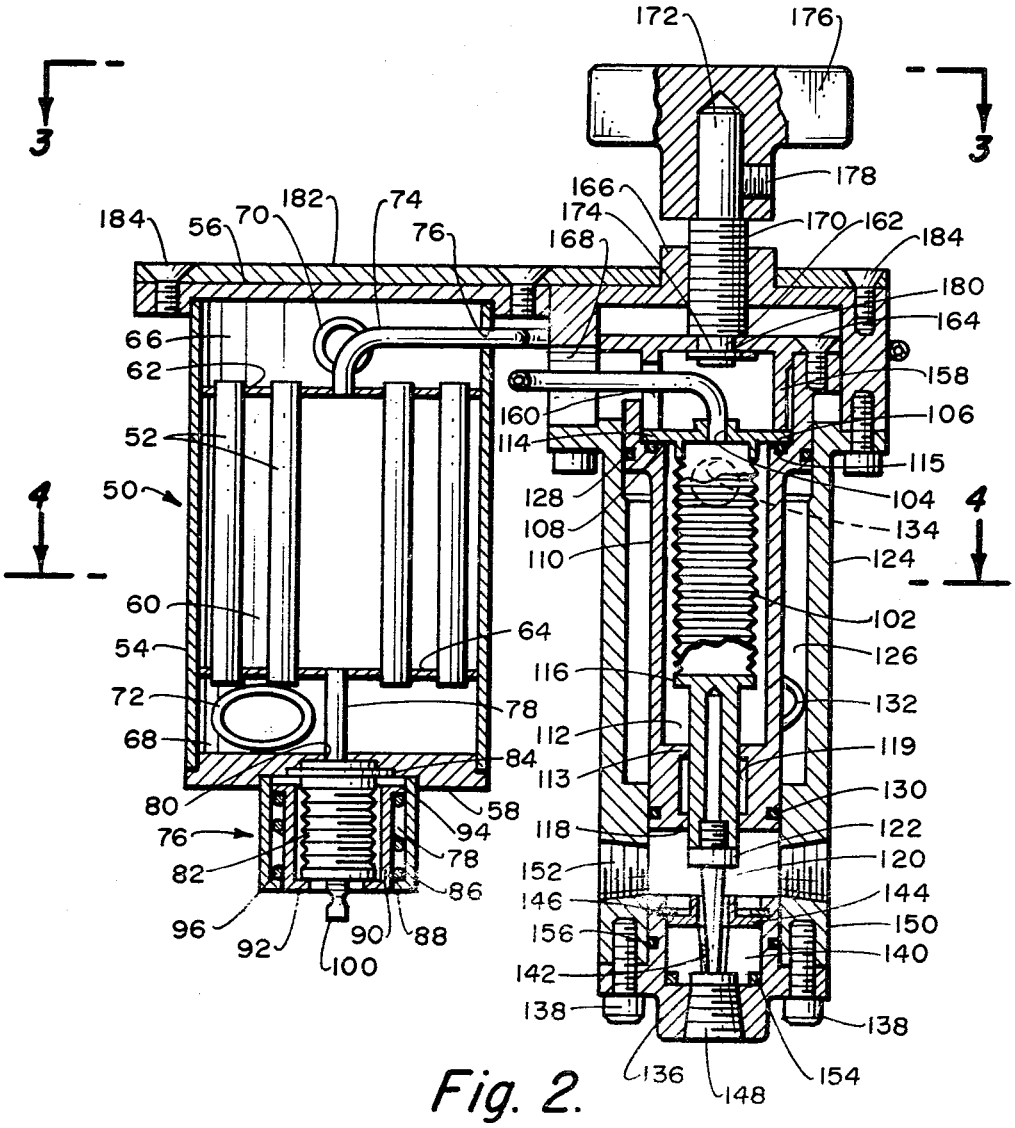
FIG. 2 is a partially cross-sectional, partially broken away view of the preferred embodiment of the gas flow valve of the present invention.
Figure 3:
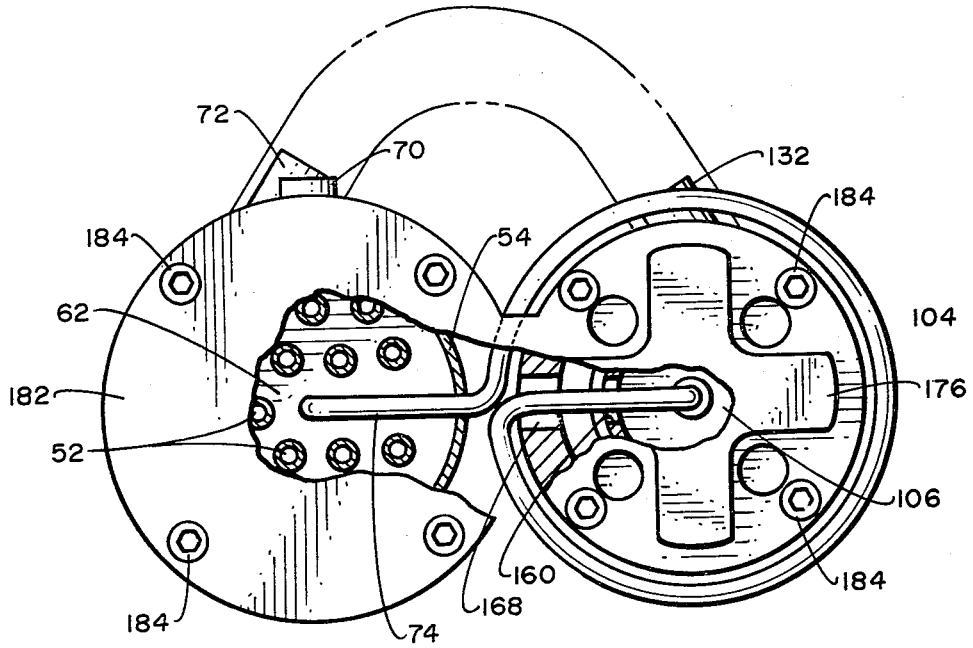
FIG. 3 is a top plan view of the thermally controlled gas flow valve.
Figure 4:
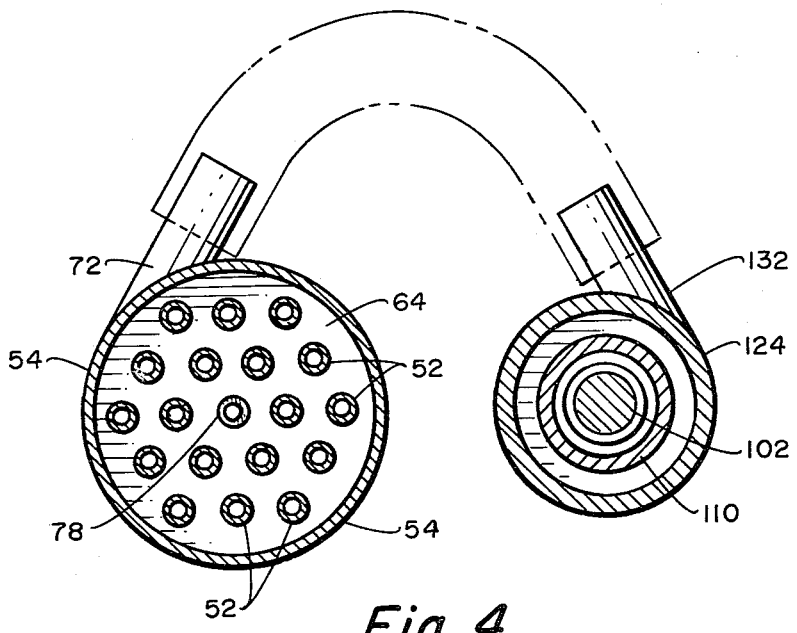
FIG. 4 is a cross-sectional view of thermally controlled gas flow valve taken along line 4—4 in FIG. 2.

The thermally controlled gas flow valve 20 is shown in FIGS. 2–4. The gas flow valve 20 has a heat exchanger denoted generally by numeral 50. The heat exchanger includes eighteen upright tubes 52 (the tube bundle) disposed intermediate the ends of a cylindrical chamber formed by a circular shell 54, a top end plate 56, and a bottom end plate 58. The tubes 52 are further disposed in a thermofluid reservoir 60 formed by the shell 54, a top reservoir cap 62 and bottom reservoir cap 64, the tubes extending through the reservoir caps into a lower header cavity 66 and an upper header cavity 68. The thermofluid reservoir 60 is filled with a fluid having a high coefficient of thermal expansion (a thermofluid) such as cyclohexane. The circular shell 54 is provided with a water inlet 70 into the upper header cavity 66 and a water outlet 72 from the lower header cavity 68 to allow water under pressure to flow into the upper header 66, downward through the tube bundle 52 into the lower header, and exit through the outlet 72. A capillary tube 74, extending from the center of reservoir top cap 62 through an aperture 75 in the shell 54, communicates with the interior of reservoir 60.

The bottom end plate 58 is adapted to receive an over pressure compensator 76 which communicates with the interior of the reservoir 60 over a capillary tube 78. The capillary tube 78 extends from the bottom cap 64 of the reservoir 60 through an aperture 80 in the bottom end plate 58 to communicate with an over-pressure bellows 82 which is secured to a bellows end cap 84 which is mounted in a recessed area of the bottom end plate. The bellows 82 is disposed in a cylindrical housing 86 fixed to the bottom end plate 58 and having an inwardly directed annular shoulder 88 at its lower end. A cylindrical pressure plate 90 having oppositely directed annular shoulders 92 and 94 is disposed between the housing 86 and the overpressure bellows 82 with the annular shoulder 92 extending inward over the bottom of the bellows. A helical spring 96 is disposed in the annular cavity 98 formed between the cylindrical housing 86 and the cylindrical pressure plate 90 so that expansion by the bellows acts against the spring force between the pressure plate 90 and housing 86. A thermofluid inlet port 100 is provided at the bottom of the bellows 82 for filling the flow control valve with the expandable fluid. The inlet 100 is shown in the sealed condition after the thermofluid has been introduced into the valve.

The first capillary tube 74 after passing through the aperture 80 in shell 54 follows a descending circular path as best shown in FIG. 3 to communicate with a motion bellows 102. The capillary tube 74 communicates with the motion bellows 102 through an aperture 104 in a bellows end plate 106 which otherwise seals the upper end of the bellows. The bellows end plate 106 is mounted on an annular shoulder 108 of a cylindrical carrier 110 with the bellows disposed in an upper chamber 112 within the carrier and bounded by the end plate 106 and an upper annular shoulder 114. The annular shoulder 108 has a circular groove (un-numbered) in which an O-ring seal 115 is disposed to provide a fluid tight seal between the shoulder 114 and the end plate 106. The lower end of the bellows is sealed by bellows extension 116 which is slidably disposed through an aperture formed by the upper annular shoulder 114 and an aperture formed by a lower annular shoulder 118 (of the carrier 110). A lower annular chamber 119 is formed between the shoulders 114 and 118. A tapered needle 120 having an annular shoulder 122 is threadably attached to the end of the bellows extension 116.

The carrier 110 is slidably disposed within a cylindrical body 124. An annular chamber 126 is formed between the body 124 and the carrier 110. A pair of O-ring seals 128 and 130 are disposed in grooves (un-numbered) in the carrier 110 to seal the annular chamber 126. The valve body is provided with a warm water inlet 132 and a warm water outlet 134 which allow the warm water under pressure to circulate through the annular chamber 126. The warm water inlet 132 on the valve body 124 communicates with the water outlet 72 of the heat exchanger 50.

A base cap 136 is joined to the bottom of the valve body 124. The base cap 136 is provided with apertures having internal screw threads for securing the base cap to the valve body with screws 138. A valve seat 140 having a tapered orifice 142 for receiving the tapered needle 120 is mounted in the base cap 136. A spacer 144, held in place by a snap ring 146, is disposed over valve seat 142 within a groove (un-numbered) in the base cap 136. The spacer 144 prevents the tapered needle 120 from being forced into the tapered orifice by contacting the needle's annular shoulder 122.

The base cap 136 has a gas aperture 148 for receiving oxygen under pressure which communicates with the lower end of the tapered orifice 142. The upper end of the orifice 142 communicates with gas apertures 150 and 152 in the valve body 124. Various O-ring seals are provided to channel the pressurized gas through the gas apertures. The base of the orifice 142 has a groove for receiving an O-ring seal 154 to seal aperture 148. O-ring seal 156 is disposed in a groove in the base cap 136 and the O-ring seal 130 (previously described) is disposed in the carrier 110 to seal apertures 150 and 152, respectively.

A cylindrical top cap 158 is mounted on the bellows end plate 106. The top cap 158 is provided with a vertical slot 160 in its sidewall through which the second capillary tube 78 passes and a central aperture for receiving a temperature adjustment member 162. The top cap 158 is secured to the carrier 110 by screws 164 which pass through apertures in the top cap 158 to mate with threaded apertures in the carrier 110.

The top cap 158 is disposed within another cylindrical cap 166 which threadably attached to valve body 124. The cap 166 has a vertical slot 168 in its side through which the second capillary passes to the motion bellows 102. The cap 166 has a central threaded aperture for receiving temperature adjustment member 162.

The temperature adjustment member 162 consists of a vertically disposed rod having a central threaded section 170 between smaller-diameter, unthreaded sections 172 and 174. A hand knob 176, abutting the top of the threaded section 170, is attached to the upper unthreaded section 172 by a set screw 178. The bottom of the threaded section 170 abuts the top cap 158 with a lower unthreaded section 174 passing through the central aperture thereof. The rod is secured to the top cap 158 by a snap-ring 180 disposed in a groove in the lower threaded section 174.

The heat exchanger 50 is secured to the valve portion by a bracket 182 which is fixed by screws 184 to the cap 166 of the valve portion.

Figure 5:
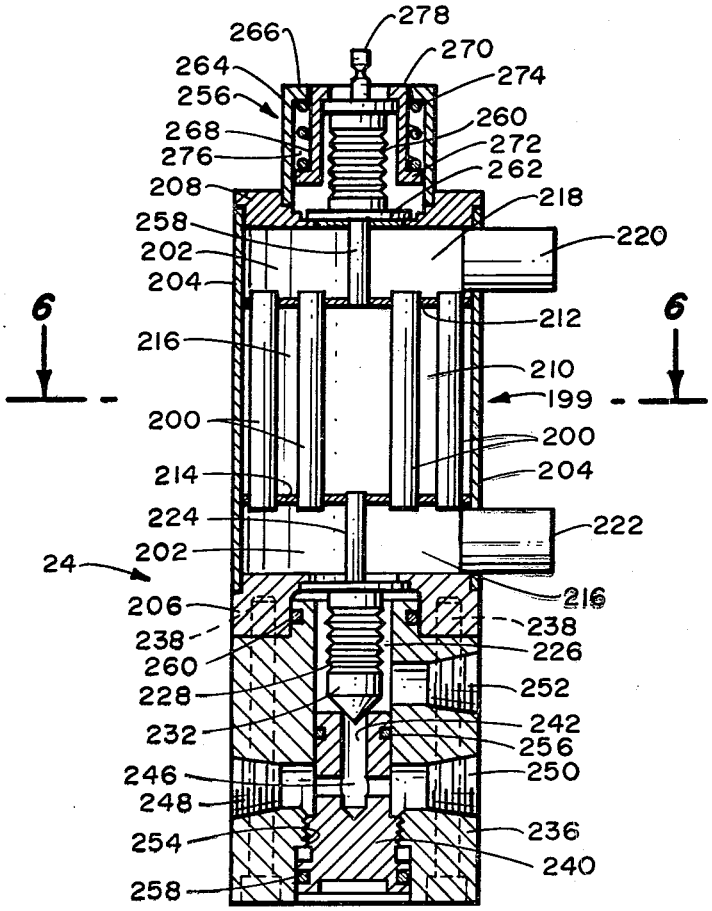
FIG. 5 is a partially cross-sectional, partially broken away view of the preferred embodiment of the thermally controlled gas shut-off valve of the present invention.
Figure 6:
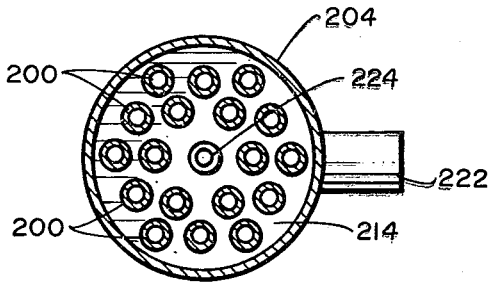
FIG. 6 is a cross-sectional view of the thermally controlled gas shut-off valve taken along line 6—6 of FIG. 5.

FIGS. 5 and 6 show the thermally controlled oxygen shut-off valve 24. The shut-off valve 24 has a heat exchanger 199 including 18 upright tubes 200 (the tube bundle) disposed in a cylindrical chamber 202 formed with a circular shell 204, a base fitting 206, and a top cap 208. The tubes 200 are further disposed in thermofluid reservoir 210 formed by shell 204, a top reservoir cap 212, and a bottom reservoir cap 214, the tubes extending through the reservoir caps into a lower header cavity 216 and an upper header cavity 218. The circular shell 204 is provided with a water inlet 220 into the upper header cavity 218 and a water outlet 222 in the lower header cavity 216 to allow water to flow under pressure into the upper header cavity, pass through the tubes of the tube bundle 200 into the lower header cavity 216, and exit through the outlet 222.

Capillary tube 224, extending from the center of the reservoir bottom cap 214 through a central aperture in the base fitting 206, communicates with the interior of the reservoir 210. The base fitting has a downwardly directed cylindrical cavity 226 in which a motion bellows 228 is mounted below the central aperture so that the interior of the bellows 228 communicates with the reservoir 210 through the capillary tube 224.

The lower end of the motion bellows 228 is sealed by a valve plug 232 having a conical lower end. The motion bellows extends into cavity 226 in a cylindrical valve body 236 which is attached to the base fitting 206 by screws 238. A valve seat 240 is disposed in the cavity 234 below the plug 232. The valve seat 240 has an orifice consisting of a longitudinal passage 242 which leads to a horizontal passage 246. The horizontal passage 246 communicates with gas ports 248 and 250 in the valve body 236. A third gas port 252 is provided in the valve body 236 above the valve seat 240.

The valve seat 240 and the valve body 236 are provided with complementary threaded portions 254 so that the placement of the valve seat in the valve body may be adjusted to control the relative positions of the valve seat and the valve plug 232. The valve seat 240 has grooves above and below the horizontal passage 246 in which fluid type O-ring seals 256 and 258 are disposed. The valve body 236 has a groove in which an O-ring 260 is disposed to provide a fluid-tight seal between valve body and the base fitting 206.

The top cap 208 on the heat exchanger is adapted to receive an over pressure compensator 256 which communicates with the interior of the thermofluid reservoir 210 via a capillary tube 258. The capillary tube 258 extends from the top reservoir cap 212 through an aperture in the top cap 208 on the heat exchanger to communicate with an over pressure bellows 260 which is secured to a bellows end cap 262 which is mounted in a recessed area of top cap 208. The bellows 260 is disposed in a cylindrical housing 264 fixed to the top cap 208 and having an inwardly directed annular shoulder 266 at its upper end. A cylindrical pressure plate 268 having oppositely directed annular shoulders 270 and 272 is disposed between the housing 264 and the over pressure bellows 260 with the annular shoulder 270 extending inward over the top of the bellows. A helical spring 274 is disposed in the annular cavity 276 formed between the cylindrical housing 264 and the cylindrical pressure plate 268 so that expansion by the bellows acts against the spring force between the pressure plate 268 and the housing 264. A thermofluid inlet 278 is provided at the top of the bellows 262 for filling the flow control valve with the expandable fluid.

Considering now the operation of the thermally controlled gas flow valve 20 and referring again to FIGS. 2–4, the thermofluid reservoir 60, the first and second capillary tubes 74 and 78, the over pressure bellows 82, and the motion bellows 102 form a closed system. This closed system is filled with the thermofluid which is introduced into the system through the fluid inlet port 100. The inlet port 100 is then sealed, for example, by crimping, to close the thermofluid system.

The heated water circulating through the diver's clothing is fed to the heat exchanger 50, entering the upper header cavity 66 through water inlet 70. The heated water flows down through the tube bundle 52 into the lower header cavity 68 and out of the heat exchanger through water outlet 72. As the temperature on the heated water varies, a small amount of heat is transferred to or from the thermofluid within the heat exchanger 50. The heat transfer changes the temperature of the thermofluid which produces a change in the volume of the thermofluid. This change in volume is transmitted through the capillary tube 74 to the motion bellows 102 causing the metallic bellows to expand or contract along its longitudinal axis.

The bellows extension 116 couples the motion of the bellows to the tapered needle 120. As the end of the bellows 102 moves back and forth along the longitudinal axis of the bellows, the tapered needle 120 moves into and out of the tapered orifice 142 in the valve seat 140. Pressurized oxygen enters the valve 20 through the gas aperture 148 in the base cap 136, passes through the tapered orifice 142, and leaves through one of the gas apertures 150 or 152 in the body 124. Typically, one of the gas exit apertures 150 and 152 will be plugged so that the valve 20 has a single oxygen output aperture. The oxygen flow through the valve 20 is varied as the tapered needle 120 moves in and out of the orifice 142.

The thermofluid volume must be carefully selected so that for a given change in temperature, a known motion results at the motion bellows 102. This motion in turn governs the taper of the needle 120. The taper of the needle 120 is chosen based on well-known techniques of needle valve design.

The thermofluid in the motion bellows 102 is not directly heated; however, temperature changes of this fluid volume due to environmental effects would result in changes in the position of the tapered needle 120. To minimize this movement of the needle 120, the hot water that leaves the heat exchanger 50 through outlet 72 is fed through the hot water inlet 132 into the annular chamber 126 surrounding the motion bellows 102 formed between the valve body 124 and the carrier 110. The warm water flows through the chamber and exits through the warm water outlet 34 to create a pseudo-constant temperature surrounding the motion bellows 110. While the temperature of the fluid surrounding carrier 110 will change, it will always be near the hot water temperature. Without the temperature compensating fluid in the annular chamber 126, the thermofluid in the motion bellows would be subject to the environmental temperature, which can not be known in advance. This would result in a non-predictable stroke for the needle 120.

The carrier 110, to which the non-movable end of motion bellows 102 is fixed and within which the bellows extends, is slidable within the valve body 124 to allow the position of the needle 120 in the orifice 142 to be adjusted manually. This allows the temperature of the circulating hot water to be adjusted. For example, moving the needle 120 into the orifice 142 manually reduces the oxygen flow through the valve 20 at that particular thermofluid temperature (which is of course directly related to the hot water temperature). This results in the lowering of the hot water temperature (because less oxygen is supplied to the combustion vessel 12) with a resultant contraction of the thermofluid and an associated withdrawal of the needle 120 from the orifice. The withdrawal causes oxygen flow to increase which results in a small temperature increase in the hot water and the thermofluid. By careful attention to the selection of the thermofluid volume, the motion bellows dimensions, and the needle design, the net result will be a lowering of the nominal hot water temperature.

The hand knob 176 and the temperature adjustment member 162 function to position the carrier 110 within the valve body 124. Rotation of the hand knob 176 causes the temperature adjustment member 162 to screw up or down within the aperture of the cylindrical cap 166 and thus move up or down relative to the valve body 124 on which the cylindrical cap 166 is mounted. The movement of the temperature adjustment member 162 is directly coupled to the carrier 110 via the top cap 158. The net result is that the carrier is moved up or down within the valve body 124 and the needle is moved in or out of the orifice 142, thereby adjusting the nominal hot water temperature.

There are two safety features that prevent inadvertent physical damage to valve parts. The spacer 144, disposed above the tapered orifice 142, provides a stop which contacts the annular shoulder 122 of the needle 120 to prevent the needle from being forced into the tapered orifice. However, if the carrier is positioned in the valve body 124 so that the shoulder 122 of the needle 120 comes against the stop as a result of thermal expansion of the thermofluid, the thermofluid system could experience an over pressure which could damage the motion bellows 102. To provide a controlled pressure relief, the thermofluid 60 is coupled to the over pressure relief bellows 82 which acts against the helical spring 96. The spring constant is chosen so that the thermofluid pressure must exceed the normal operating pressure before the pressure relief bellows 82 is actuated appreciably.

The thermofluid is automatically pressure compensated for changes in the ambient pressure. This occurs because the pressure relief bellows 82 is exposed to the ambient water pressure and motion bellows 102 is exposed to the gas pressure of the gas supply 16. The gas supply 16 and the pressure regulator 18 provide oxygen in a small fixed pressure above the ambient. The gas entering through gas aperture 148 passes through the clearance between the bellows extension 116 and the carrier 110 to fill the chamber 112 surrounding the motion bellows 102. The effective pressure of the thermofluid is thus the ambient water pressure plus a small fixed pressure above the ambient.

The gas flow control valve 20 is also inherently compensated for a change in gas density. The density of the oxygen increases with increasing depth because the gas source 16 delivers oxygen at a pressure just above ambient. Normally, this results in a higher power output from the combustion process, but since the higher power results in a higher water temperature, the flow control valve 20 restricts gas flow appropriately to control the water temperature.

Considering now the operation of the thermally controlled gas shut-off valve 24 shown in FIGS. 4 and 5, the thermofluid reservoir 210, the capillary tubes 224 and 258, the motion bellows 228, and the over pressure bellows 260 form a closed system. This closed system is filled with the thermofluid which is introduced into the system through the fluid inlet port 278. The inlet port 278 is then sealed, for example, by crimping to close the thermofluid system.

The heated water circulating through the diver's clothing is fed to the heat exchanger 199, entering the upper header cavity 218 through water inlet 220. The heated water flows down through the tube bundle 200 into the lower header cavity 216 and out of the heat exchanger through water outlet 222. As the temperature of the heated water varies, a small amount of heat is transferred to or from the thermofluid within the heat exchanger 199. The heat transfer changes the temperature of the thermofluid which produces a change in the volume of the thermofluid. This change in volume is transmitted through the capillary tube 224 to the motion bellows 228 causing the metallic bellows to expand or contract along its longitudinal axis.

As the end of the bellows 228 moves back and forth along its longitudinal axis, the conical end of the valve plug 232 moves into and out of the longitudinal passage 242 of the orifice in the valve seat 240 to close or open the longitudinal passage. Pressurized oxygen (from the flow control valve 20) is fed to shut-off valve 24 through either gas port 248 or 250 (one of the gas ports 248 or 250 is plugged in normal operation) in the valve body 236, passes through the passages in the valve seat 240 and leaves through the gas port 252. The oxygen flow through the valve is opened or shut-off as the valve plug 232 moves into and out of the orifice in the valve seat 240. The relatively large apex angle of the valve plug 232 allows the orifice to be closed or opened by a small expansion or contraction of the bellows 228. The relatively large volume of the reservoir when coupled to the relatively small volume and small cross-sectional area of the bellows, allows the valve 24 to be closed rapidly with a small change in thermofluid temperature.

The shut-off temperature is determined by position of the orifice relative to the valve plug 232. The position of the valve plug 232 is adjustable in the valve body so that the distance the motion bellows must move to open or close the orifice may be adjusted. The valve seat 240 may be screwed into or out of the valve body 236 to adjust this distance.

The over pressure relief bellows 260 is provided to prevent damage to the motion bellows 228 resulting from too great a pressure in the thermofluid system. The fluid pressure is coupled to the pressure relief bellows 260 to provide controlled pressure relief. The pressure relief bellows expands against the spring 274 to increase the capacity of the thermofluid system and thus reduce the pressure.

The thermofluid in the shut-off valve 24 is automatically pressure compensated for changes in the ambient pressure in the same manner as the thermofluid in the flow control valve 20. This occurs because the pressure relief bellows 260 is exposed to the ambient water pressure and the motion bellows 228 is exposed to the gas pressure of the gas supply. The gas entering through gas port 248 surrounds a motion bellows 228 within the valve body 236. Thus the effective pressure of the thermofluid is the ambient water pressure plus a small fixed pressure above the ambient.

It is noted that the thermofluid is chosen based on the temperature range at which the valve is to operate and that the thermofluid must have a boiling point above the operating temperature. A thermofluid with a higher coefficient of thermal expansion in the operating temperature range is preferred over a fluid having a lower coefficient because the volume of thermofluid needed to produce the required thermal expansion is less. Thus the size of the thermofluid reservoir and the valve may be reduced if desired.

Obviously, many modifications and variations of the present invention are possible in the light of the above teachings. It is therefore to be understood that within the scope of the appended claims the invention may be practiced otherwise than as specifically described.

What is claimed is:

1. A thermally controlled gas flow valve in which the gas flow through said valve is a function of the temperature of a first fluid comprising:

seat means having an orifice therethrough, a gas being fed under pressure into one end of said orifice;

means for transferring heat between the first fluid and a second fluid having a high coefficient of thermal expansion, including:

a reservoir filled with said second fluid; and a plurality of tubes disposed within said reservoir, said plurality of tubes being coupled to receive said first fluid so that said first fluid passes through said tubes, said first and second fluid being in thermal contact with each other through said tubes so that heat may be transferred between said fluids;

means for opening or closing said orifice through which gas may flow as a function of the volume of the second fluid, including;

expansion bellows means communicating with said reservoir to receive said second fluid so that an increase or decrease in the volume of said second fluid produces an expansion or contraction, respectively, of said bellows means along its longitudinal axis, and a plug coupled to said bellows means so that expansion and contraction of said bellows means moves said plug to open or close said orifice for varying the cross-sectional area of the passageway therethrough, thereby controlling the gas flow through said orifice;

a valve body having a cavity, said expansion bellows and seat means being disposed therein; the cavity communicating with said orifice so that the gas passing through said orifice may flow to surround said bellows means in said cavity;

means for protecting said expansion bellows means from over pressure due to expansion of said second fluid; said means for protecting said expansion bellows from over pressure due to expansion of said second fluid including:

a housing having an inwardly directed shoulder;

second bellows means communicating with said reservoir for receiving said second fluid and disposed in said housing;

a pressure plate disposed between said housing and said second bellows, said pressure plate having an inwardly directed shoulder extending over the movable end of said second bellows and an outwardly directed shoulder on the other end, a cavity being formed between said pressure plate and said housing; and a spring disposed in said cavity between said pressure plate and said housing, whereby expanding of the second bellows acts against the spring force between the pressure plate and the housing.

2. Apparatus as recited in claim 1 wherein said plug has a conical end for sealing said orifice.

3. Apparatus as recited in claim 1 wherein the position of said seat means in said valve body is adjustable so that the position of the orifice relative to the plug may be adjusted.

* * * * *